US006041954A

United States Patent [19]

Savioz

[11] Patent Number: 6,041,954

[45] Date of Patent: Mar. 28, 2000

[54] CONTAINER FOR LIQUIDS, PARTICULARLY FOR WINE AND SPIRITS

[76] Inventor: Cyrille Savioz, CH-1974, Arbaz, Switzerland

[21] Appl. No.: 09/180,187

[22] PCT Filed: Mar. 5, 1998

[86] PCT No.: PCT/CH98/00089

§ 371 Date: Nov. 3, 1998

§ 102(e) Date: Nov. 3, 1998

[87] PCT Pub. No.: WO98/45192

PCT Pub. Date: Oct. 15, 1998

[51] Int. Cl.[7] ..... B65D 88/52

[52] U.S. Cl. ..... 217/4; 220/4.33; 220/4.17; 220/608; 220/676

[58] Field of Search ..... 220/571, 4.33, 220/4.34, 608, 676, 4.16, 4.17; 217/73, 4, 12 R, 13, 17

[56] References Cited

U.S. PATENT DOCUMENTS 3,964,636 6/1976 Rehrig ..... 220/676
4,093,099 6/1978 Spooner ..... 217/72
4,930,648 6/1990 Hundt ..... 220/676
4,953,730 9/1990 Prime et al. ..... 217/4

*Primary Examiner*—Stephen Castellano
*Attorney, Agent, or Firm*—Clifford W. Browning; Woodard, Emhardt, Naughton, Moriarty & McNett

[57] ABSTRACT

Container for liquids, particularly for wine and spirits, characterized in that it has essentially a rectangular parallelepipedic or cubic shape and comprises six panels forming the faces of the container, i.e. a bottom panel, a top panel, a front panel, a rear panel and two side panels, the top panel having at the proximity of its front edge and substantially in the middle between the side panels a filling hole; the internal surface of the top panel forms with respect to a horizontal plane three corners, that is a first prismatic corner presenting a planar surface which is inclined with respect to a horizontal plane downwardly from the front panel towards the rear panel, and two side corners presenting each a planar surface which is inclined towards said inclined surface of the first corner from a point of the interior ridge formed by a corresponding side panel and the front panel up to the vicinity of the filling hole.

8 Claims, 2 Drawing Sheets

CONTAINER FOR LIQUIDS, PARTICULARLY FOR WINE AND SPIRITS

The present invention is concerned with a container for liquids, in particular for wine and for strong alcohols.

With the advent of cooperage, amphorae and other ancient flasks, which were too easily broken, were replaced by casks, barrels, vats and tuns and other containers of various capacities, made of wood and in particular oak-wood. More recently, such containers were made of metal, in particular of stainless steel, while retaining the shape of usual barrels, which offers the advantage of a certain facility of handling and of a relatively small volume of air in the vicinity of the filling opening, above the surface of the liquid filling the barrel.

The present invention is aimed at providing a container, which, while allowing the use of conventional wood as the preferred material but also of other materials such as metal and while retaining the advantage of a reduced volume of air in the filled container, would also be much cheaper to manufacture than the conventional barrels and would facilitate, in particular, the transport, the storage and further the disassembling and the reassembling of these containers.

To this end, the container according to the invention is characterised in that it has substantially the shape of a rectangular parallelepiped or of a cube and in that it comprises six panels forming the faces of the container, namely a bottom panel, a top panel, a front panel, a back panel and two side panels, the top panel having, in the vicinity of its front edge, substantially in the middle between the side panels, a filling hole, the inner surface of the top panel forming, with respect to a horizontal plane, three wedges, namely a first prismatic wedge exhibiting a surface which slopes downwards relative to a horizontal plane, in the direction from the front panel to the back panel and two side wedges having each one a flat surface sloping towards said sloping surface of the first wedge from one point located on the inner ridge formed by a corresponding side panel and the front panel, up to the vicinity of said filling hole.

Preferably, the first wedge is provided for by the sloping of a top panel of a constant thickness, each one of the lateral wedges consisting of a piece which is substantially of a tetrahedral shape.

The front panel can include an outlet hole in the vicinity of the bottom panel, this bottom panel sloping preferably downwards in the direction of the front panel.

The top and the bottom panels are preferably mounted between the two side panels and the assembly carries advantageously joining grooves at the positions of junction between the different panels. Sealing members can be placed in these joining grooves.

According to a preferred embodiment, the container is provided with spars disposed at least on the side panels, two opposite spars being held at their ends by two metal rods extending over the width of the top and of the bottom panels. Advantageously, these rods have at least one threaded end for receiving a nut.

Other characteristics, objects and advantages of the invention will become apparent from the description made hereafter of an exemplary embodiment illustrated in the appended drawing, wherein FIG. 1 is a perspective view of a container according to the invention;

Figure 1:
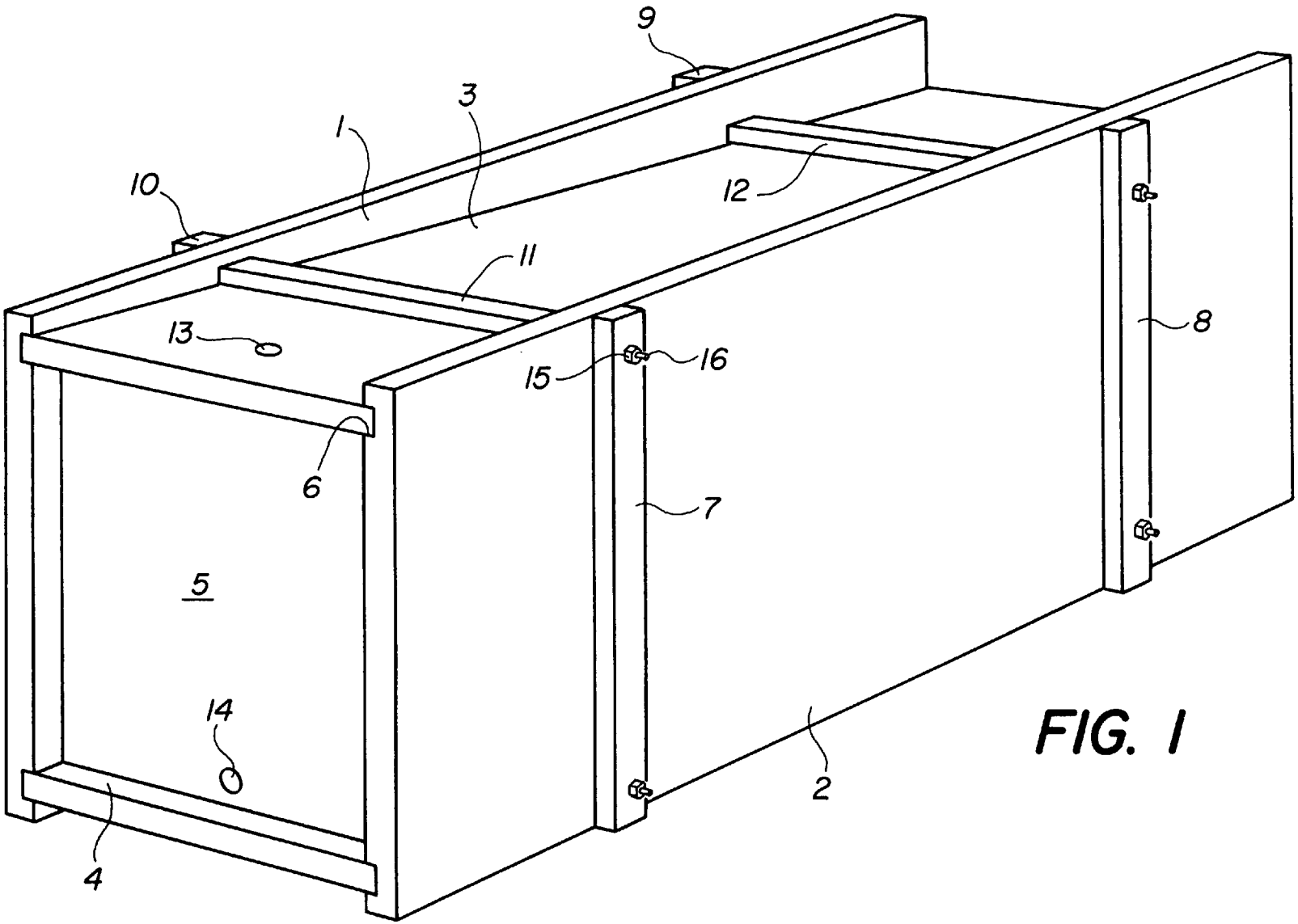

FIG. 1 shows the general shape of the container of which the envelope is a rectangular parallelepiped. This container is formed from six panels, for example made of oak-wood, of which one can see in FIG. 1 the side panels 1 and 2, the top panel 3, the bottom panel 4 and the front panel 5, whereas the back panel is not visible. The different panels are assembled by means of joining grooves, such as 6, and the assembly is reinforced, in this example, by side spars 7, 8, 9 and 10 and by horizontal spars disposed on the top and bottom panels, of which only the spars 11 and 12 can be seen in FIG. 1.

The top panel 3 has a filling hole 13 in the vicinity of the front panel 5 and this front panel has an emptying hole 14 in the vicinity of the bottom panel 4. In FIG. 1, one can also distinguish nuts, such as 15, which are mounted on rods, such as 16, extending through the side panels I and 2 and the corresponding spars, for example 7, 11, 10, over the full width of the top and of the bottom panels, to ensure that the whole container remains assembled.

Figure 2:
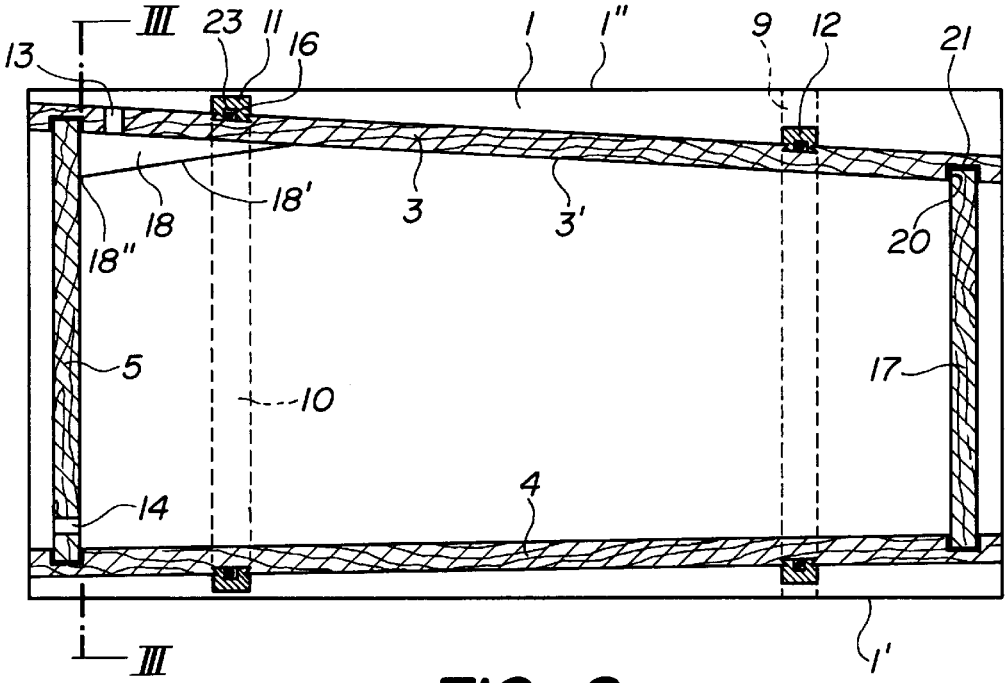
FIG. 2 is a cross-sectional view of the container of FIG. 1, taken longitudinally.

FIG. 2 shows in a longitudinal cross-section the position of the top panel 3, which is of a constant thickness and which slopes downwards in the direction from the front panel 5 to the back panel 17, so that the inner surface 3' of this top panel is at an angle with respect to a horizontal plane, such a horizontal plane extending, in the normal position of use of the container, along the lower edges or the upper edges of the opposite side panels, such as the edge 1' or the edge 1" of panel 1, as indicated in FIG. 2. The sloping surface 3' thus defines a prismatic wedge inside the volume of the container, relative to the shape of a rectangular parallelepiped.

Figure 3:
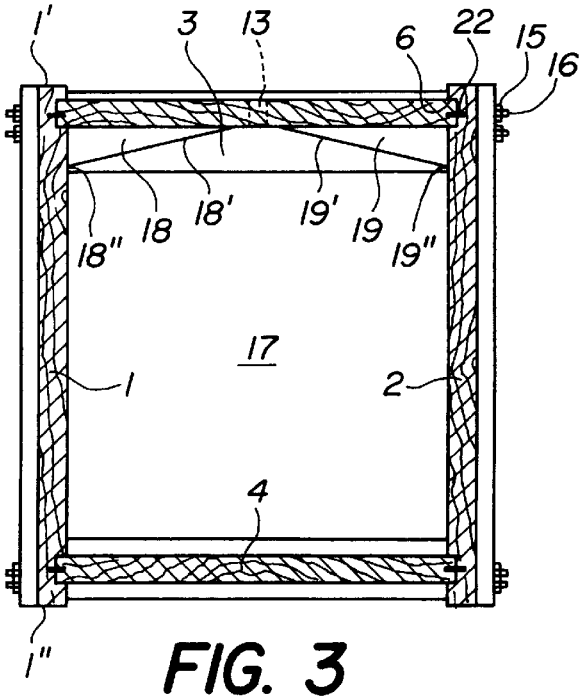
FIG. 3 is a cross-sectional view taken along line III—III of FIG. 2.

One can also see in FIG. 2, as well as in FIG. 3, the disposition on the surface 3' of two wedge-shaped pieces 18 and 19, exhibiting respective flat surfaces 18' and 19' sloping upwards, i. e. in the direction of the surface 3', respectively from a point 18" located on the inner ridge formed by the front panel 5 and the side panel 1 and from a point 19" located on the inner ridge formed by the panel 5 and the panel 2.

It is apparent from FIGS. 2 and 3, that the surfaces 3', 18' and 19' of the wedges restrict the free space in the vicinity of the filling hole 13 in such a manner as to make very small the volume of residual air, when the container is filled with liquid in the horizontal position. Accordingly, the surface of the liquid exposed to oxidation by the air contained in the filled container is also very small.

Furthermore, FIG. 2 shows that the bottom panel 4 of the container slopes slightly downwards in the direction from the back panel 17 to the front panel 5, which facilitates the emptying of the container via the hole 14.

Furthermore, the sectional views of FIGS. 2 and 3 show that the joining grooves, such as 20, are provided with a sealing member such as 21, which is U-shaped in cross-section and is wrapped around the edge of the panel, such as panel 17, inserted into the groove, in such a manner as to ensure a leak-proof junction between the panels. Another manner for leak-proofing the junction is illustrated in FIG. 3 for the longitudinal grooves, such as 6, wherein a joint 22 having the shape of a strip is inserted into the grooves of the panels to be assembled, perpendicularly to the bottom of the groove and the edge of the panel entering into this groove.

Furthermore, FIG. 2 shows the disposition of the horizontal spars on the top panel 3 and on the bottom panel 4, these spars, such as 11, being fastened to the corresponding panels by a dovetail joint. The lower side of these spars exhibits a longitudinal groove, such as 23, into which will be housed the corresponding metal rod, such as 16, provided at its ends with fastening nuts, such as 15.

Figure 4:
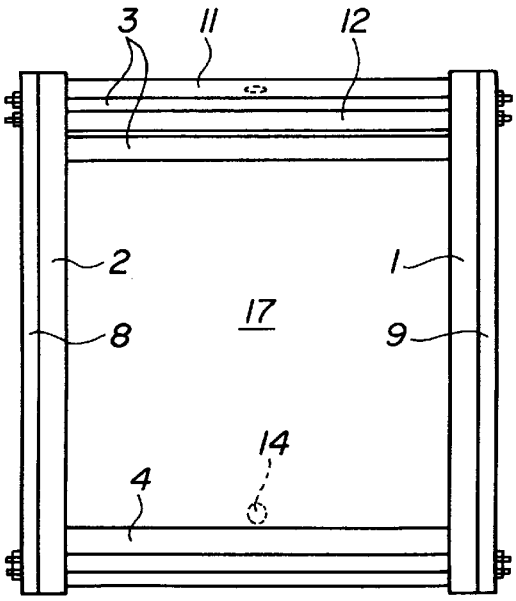
FIG. 4 is a rear view of the same container.

FIG. 4 is a rear view of the container, provided to fully illustrate the present embodiment, the components shown being designated by the same reference numerals as in the preceding figures.

From the above, it is clearly apparent that the container according to the invention can be made in such a manner as to be totally leak-proof, from panels which can be made at a very low cost, using automated machinery, the design of the container enabling, furthermore, an easy assembling and disassembling of the different components. An essential characteristic feature of the container according to the invention lies in the reduction of the volume of residual air, owing to the presence of three wedge surfaces apexing in the vicinity of the filling hole.

The outer shape of the container, such as defined by its envelope forming a rectangular parallelepiped, of which the two rectangular side panels are part, makes possible a stacking of the containers and an optimal use of the space available, whether during transport, storage or use.

I claim:

1. A container for liquids having a substantially quadratic shape comprising six panels forming the faces of the container, namely a bottom panel, a top panel, a front panel, a back panel and two side panels, the top panel having, in the vicinity of its front edge, substantially in the middle between the side panels, a filling opening, the inner surface of the top panel forming, with respect to a horizontal plane, three wedges, namely a first prismatic wedge exhibiting a surface which slopes downwards relative to a horizontal plane, in the direction from the front panel to the back panel and two side wedges having each one a flat surface sloping towards said sloping surface of the first wedge from one point located on the inner ridge formed by a corresponding side panel and the front panel, up to the vicinity of said filling hole, the container including a joining groove at the location of the junction between the panels.

2. A container according to claim 1, wherein sealing members are arranged in said joining grooves.

3. A container according to claim 1, wherein the container is provided with spars disposed at least on the side panels, two opposite spars being connected together at their ends by two metal rods extending over the width of the top and of the bottom panels.

4. A container according to claim 3, wherein said rods include at least one threaded end, provided with a nut.

5. A container according to claim 1, wherein said first wedge is formed by the sloping of a top panel of a constant thickness, each one of the side wedges being substantially of a tetrahedral shape.

6. A container according to claim 1, wherein the front panel includes an emptying hole in the vicinity of the bottom panel, this bottom panel being sloped downwards in the direction of the front panel.

7. A container according to claim 1, wherein the top and the bottom panels are mounted between the two side panels.

8. A container without bag for directly receiving wine and other alcohols, the container having a substantially quadratic shape comprising six panels forming the faces of the container, namely a bottom panel, a top panel, a front panel, a back panel and two side panels, the top panel having, in the vicinity of its front edge, substantially in the middle between the side panels, a filling opening, the inner surface of the top panel forming, with respect to a horizontal plane, three wedges, namely a first prismatic wedge exhibiting a surface which slopes downwards relative to a horizontal plane, in the direction from the front panel to the back panel and two side wedges having each one a flat surface sloping towards said sloping surface of the first wedge from one point located on the inner ridge formed by a corresponding side panel and the front panel, up to the vicinity of said filling hole.

* * * * *